US005082090A

United States Patent [19]

Walker

[11] Patent Number: 5,082,090

[45] Date of Patent: Jan. 21, 1992

[54] STACKING MAST FOR A LIFT TRUCK

[75] Inventor: Evo M. Walker, Louisville, Miss.

[73] Assignee: Taylor Machine Works, Inc., Louisville, Miss.

[21] Appl. No.: 660,686

[22] Filed: Feb. 25, 1991

Related U.S. Application Data

[63] Continuation-in-part of Ser. No. 535,504, Jun. 11, 1990, abandoned.

[51] Int. Cl.[5] ..... B66B 9/20

[52] U.S. Cl. ..... 187/9 E; 414/631; 414/678

[58] Field of Search ..... 187/9 R, 9 E, 95; 414/629, 631, 636, 678

[56] References Cited

U.S. PATENT DOCUMENTS

| | | | |
|---|---|---|---|
| 2,399,632 | 5/1946 | Guerin | 187/9 E |
| 2,641,336 | 6/1953 | Chanda | 187/9 E |
| 2,767,394 | 10/1956 | Arnot et al. | 414/636 X |
| 2,918,143 | 12/1959 | Shaffer | 187/9 E |
| 3,841,442 | 10/1974 | Erickson et al. | 187/9 E X |
| 4,614,253 | 9/1986 | Furukawa | 187/9 E |
| 4,889,038 | 12/1989 | Bentivoglio | 187/9 R X |

FOREIGN PATENT DOCUMENTS 640138 7/1950 United Kingdom .

*Primary Examiner*—D. Glenn Dayoan
*Assistant Examiner*—Dean A. Reichard
*Attorney, Agent, or Firm*—Walker & McKenzie

[57] ABSTRACT

A stacking mast for being attached to a lift truck and for moving a load between a negative position and a positive position. The stacking mast includes an elongated first mast, the first mast including a lower end for being attached to the lift truck and including an upper end; an elongated second mast, the second mast including a lower end and an upper end; a floating carriage having a first securing structure for being slidably secured to the first mast and a second securing structure for being slidably secured to the second mast; a support carriage slidably attached to the second mast for supporting the load; and lift structure for moving the support carriage between a lower position and an upper position on the second mast and for moving the second mast between a lower position and an upper position on the first mast. A second embodiment is also described in which one or both of the first or second masts may telescope, allowing a reduced un-telescoped height for passing through doorways or under obstacles, while substantially preserving the full positive and negative lift.

27 Claims, 8 Drawing Sheets

STACKING MAST FOR A LIFT TRUCK

CROSS-REFERENCE TO RELATED APPLICATION

This is a continuation-in-part of my application, Ser. No. 07/535,504, filed June 11, 1990, now abandoned entitled "Stacking Mast for a Lift Truck."

BACKGROUND OF THE INVENTION

1. Field of the Invention

The present invention relates, in general, to masts for lift trucks and more specifically to a stacking mast for a marina fork lift truck.

2. Information Disclosure Statement

A preliminary patentability search in class 414, subclass 678, and class 187, subclass 9E, disclosed the following patents, some of which may be relevant to the present invention: Harris, U.S. Pat. No. 2,886,197, issued May 12, 1959; Crosby et al., U.S. Pat. No. 3,029,959, issued Apr. 17, 1962; Peck, U.S. Pat. No. 3,174,634, issued Mar. 23, 1965; Pusztay, U.S. Pat. No. 3,330,383, issued July 11, 1967; McIntosh, U.S. Pat. No. 3,433,324, issued Mar. 18, 1969; Wilson, U.S. Pat. No. 3,602,385, issued Aug. 31, 1971; Erickson et al., U.S. Pat. No. 3,841,442, issued Oct. 15, 1974; Soule et al., U.S. Pat. No. 4,485,894, issued Dec. 4, 1984; Griesenbrock et al., U.S. Pat. No. 4,506,764, issued Mar. 26, 1985; and Tworoger et al., U.S. Pat. No. 4,797,055, issued Jan. 10, 1989. Additionally, during prosecution of the predecessor to this application, the following patents were cited: Arnot et al., U.S. Pat. No. 2,767,394, issued Oct. 16, 1956; Guerin, U.S. Pat. No. 2,399,632, issued May 7, 1946; Bentivoglio, U.S. Pat. No. 4,889,038, issued Dec. 26, 1989; and Burton, U.K. Patent No. 640,138, published July 12, 1950. While each of the above patents disclose a mast or the like, none disclose or suggest the present invention. More specifically, none of the above patents disclose or suggest a stacking mast including, in general, an elongated first mast, the first mast including a lower end for being attached to the lift truck and including an upper end; an elongated second mast, the second mast including a lower end and an upper end; a floating carriage means for securing the second mast to the first mast, the floating carriage means including first securing means for being slidably secured to the first mast and including second securing means for being slidably secured to the second mast; a support carriage slidably attached to the second mast for supporting the load; an lift means for moving the support carriage between a lower position and an upper position on the second mast and for moving the second mast between a lower position and an upper position on the first mast. In particular, Arnot et al., U.S. Pat. No. 2,767,394, while showing a lift truck with a first and second mast, has no floating carriage means for securing the second mast to the first mast which is slidably secured to the front mast and also slidably secured to the second mast.

SUMMARY OF THE INVENTION

The present invention is directed toward providing an improved mast for a lift truck or the like which allows a high positive lift height and a low negative lift height. The concept of the present invention is to provide a stacking mast for a marina fork lift truck that can descend a negative lift height distance, typically ten feet, below the level of a boat dock to lift a boat from the water and extend a positive lift height distance, typically thirty feet, above the dock to store the boat on a storage rack. Actual lift height distances may be chosen to be more or less by appropriate scaling of the dimensions of the present invention in a manner well known to those skilled in the art.

The stacking mast of the present invention includes, in general, an elongated first mast, the first mast including a lower end for being attached to the lift truck and including an upper end; an elongated second mast, the second mast including a lower end and an upper end; a floating carriage means for securing the second mast to the first mast, the floating carriage means including first securing means for being slidably secured to the first mast and including second securing means for being slidably secured to the second mast; a support carriage slidably attached to the second mast for supporting the load; and lift means for moving the support carriage between a lower position and an upper position on the second mast and for moving the second mast between a lower position and an upper position on the first mast. This arrangement of the mast and carriage components allows one mast upright (rail) to be utilized to accomplish positive and negative lifts with less weight and less lowered height than other arrangements of mast and carriage components to accomplish the same combination of positive and negative lift with adequate overlap to maintain practical main and side roller loads.

The present invention makes it possible, with a floating carriage and a stacked mast (one in front of the other) requiring a thirty foot positive and a ten foot negative lift, to maintain the same positive and negative lift with five foot less front and rear mast rail length. This is accomplished using the same main roller spacing and approximately the same load on the main rollers. Also, while the above is accomplished, the overall lowered height is five foot less, meaning that door heights can be less. These features cannot be accomplished by any known prior art two-stage arrangement.

A second embodiment is also described in which one or both of the first or second masts telescopes, allowing a reduced un-telescoped height for passing through doorways or under obstacles, while substantially preserving the full positive and negative lift previously described.

DESCRIPTION OF THE PREFERRED EMBODIMENT

Figure 1:
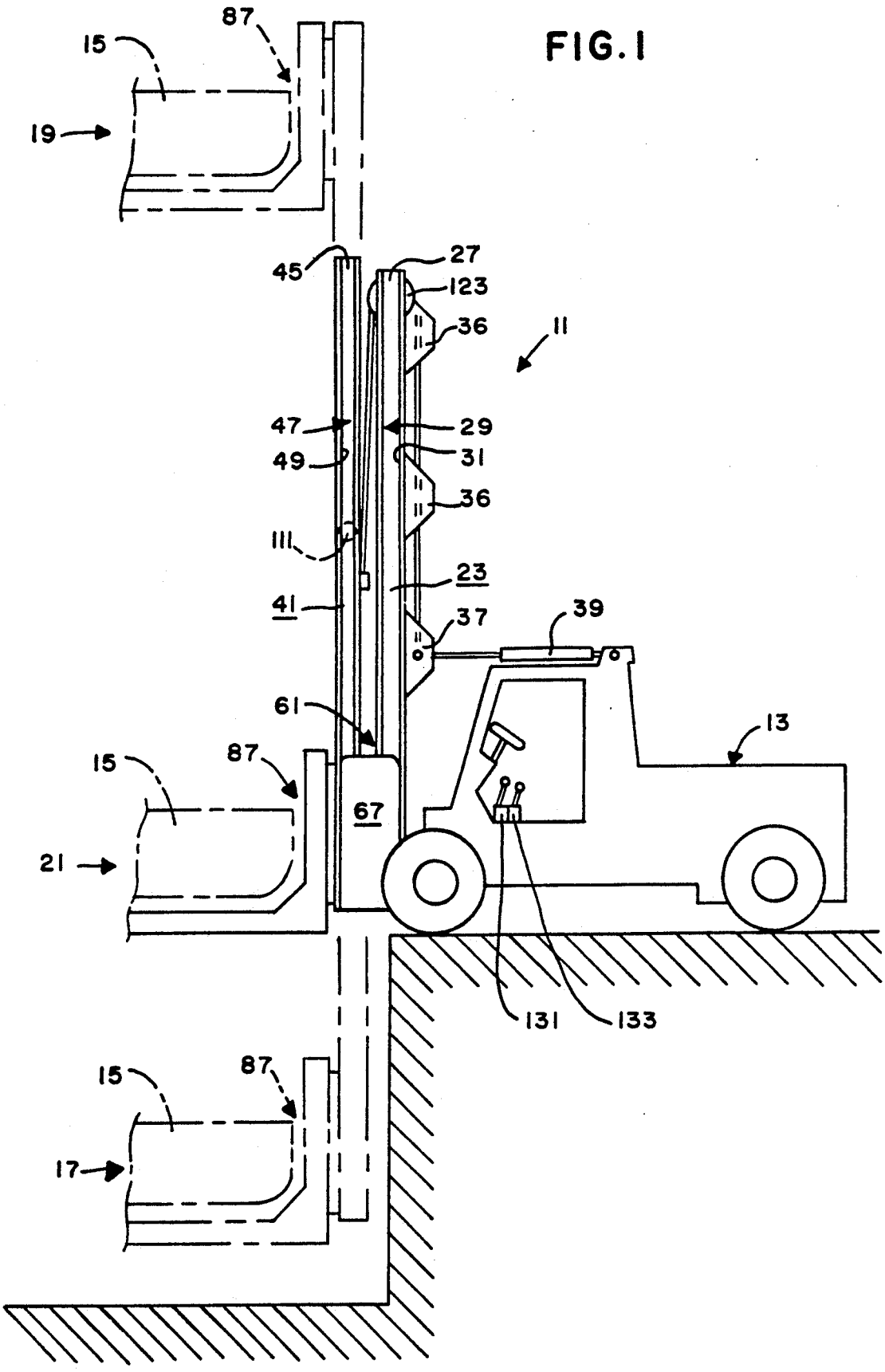
FIG. 1 is a diagrammatic side elevational view of the stacking mast of the present invention shown attached to a marina lift truck with positive and negative positions shown in broken lines.

The preferred first embodiment of the stacking mast 11 of the present invention, shown in FIGS. 1–6, is for attachment to a typical marina lift truck 13 for moving a boat 15 between a negative position as indicated by the arrow 17 in FIG. 1 and a positive position as indicated by the arrow 19 in FIG. 1. A neutral position with the boat 15 substantially at ground level is indicated by the arrow 21 in FIG. 1.

The stacking mast 11 includes a elongated first mast 23. The first mast 23 includes a lower end 25 for being attached to the lift truck 13 in any manner now apparent to those skilled in the art such as, for example, by a pivot rod or the like. The first mast 23 includes an upper end 27. The first mast 23 preferably includes a first side 29 having an outwardly facing channel 31 extending between the lower and upper ends 25, 27 thereof, and preferably includes a second side 33 having an outwardly facing channel 35 extending between the lower and upper ends 25, 27 thereof. The specific construction of the first mast 23 may vary as will now be apparent to those skilled in the art. For example, the first and second sides 29, 33 of the first mast 23 may be constructed as elongated metal C-beams as diagrammatically shown in FIG. 2 with various cross members or cross braces 36 and the like fixedly joining the two C-beams to one another as will now be apparent to those skilled in the art. The first mast 23 is preferably provided with various flanges 37 and the like to allow the first mast 23 to be easily attached to the truck 13 and to allow various pistons and the like such as the tilt piston 39 (see FIG. 1) to be secured thereto for reasons and in a manner as will now be apparent to those skilled in the art.

The stacking mast 11 includes an elongated second mast 41. The second mast 41 includes a lower end 43 and an upper end 45. The second mast 41 preferably includes a first side 47 having an outwardly facing channel 49 extending between the lower and upper ends 43, 45 thereof and having an inwardly facing channel 51 extending between the lower and upper ends 43, 45 thereof. The second mast 41 preferably includes a second side 53 having an outwardly facing channel 55 extending between the lower and upper ends 43, 45 thereof and a inwardly facing channel 57 extending between the lower and upper ends thereof 43, 45. The specific construction of the second mast 41 may vary as will now be apparent to those skilled in the art. For example, the first and second sides 47, 53 of the second mast 41 may be constructed as elongated metal I-beams as diagrammatically shown in FIG. 2 with various cross braces 59 and the like fixedly joining the two I-beams to one another as will now be apparent to those skilled in the art.

Figure 2:
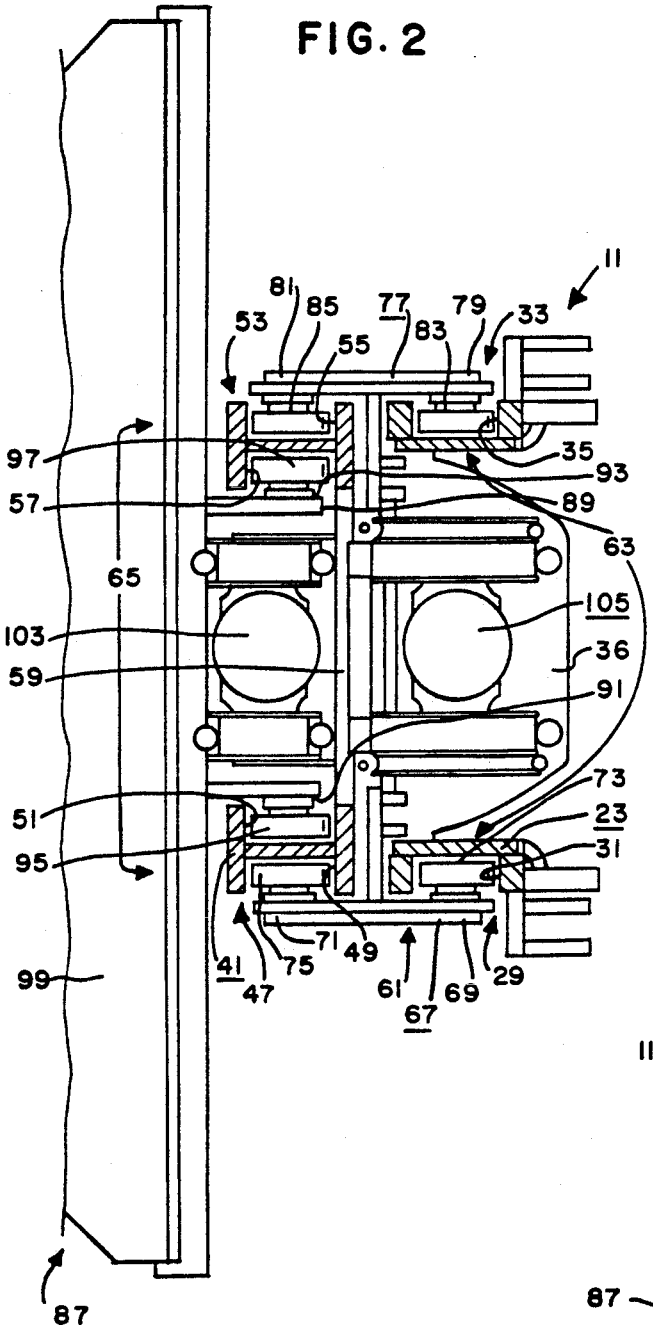
FIG. 2 is a top plan view of the stacking mast of the present invention.
Figure 3:
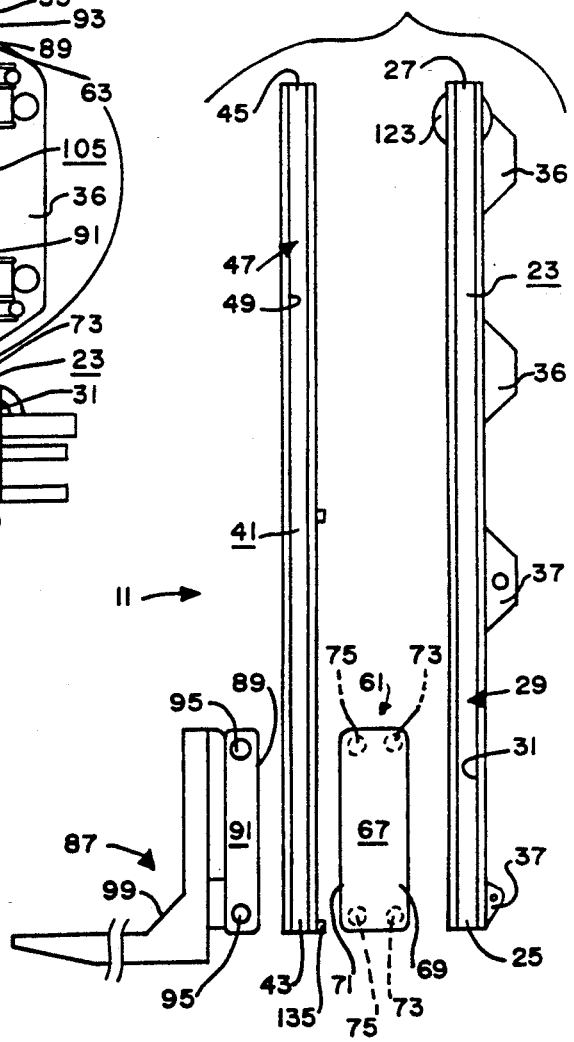
FIG. 3 is an exploded side elevational view of the stacking mast of the present invention in a neutral position.
Figure 4:
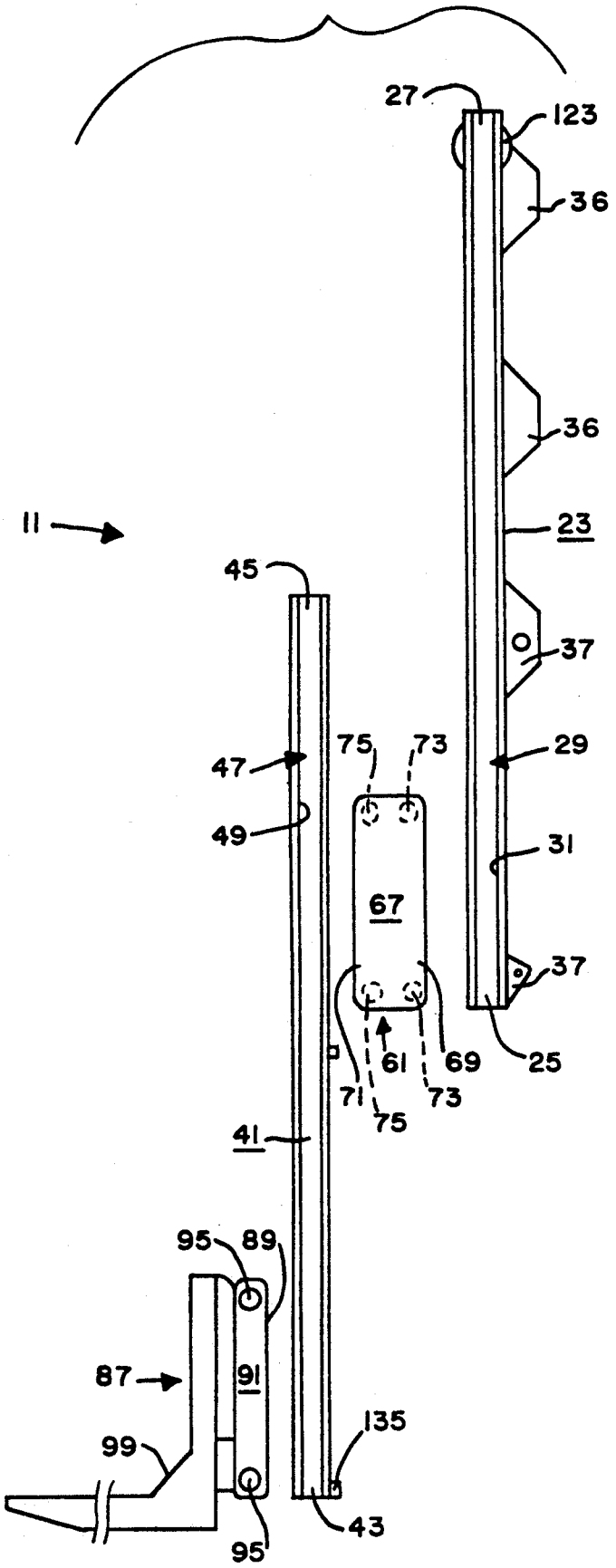
FIG. 4 is an exploded side elevational view similar to FIG. 3 but in a negative position.
Figure 5:
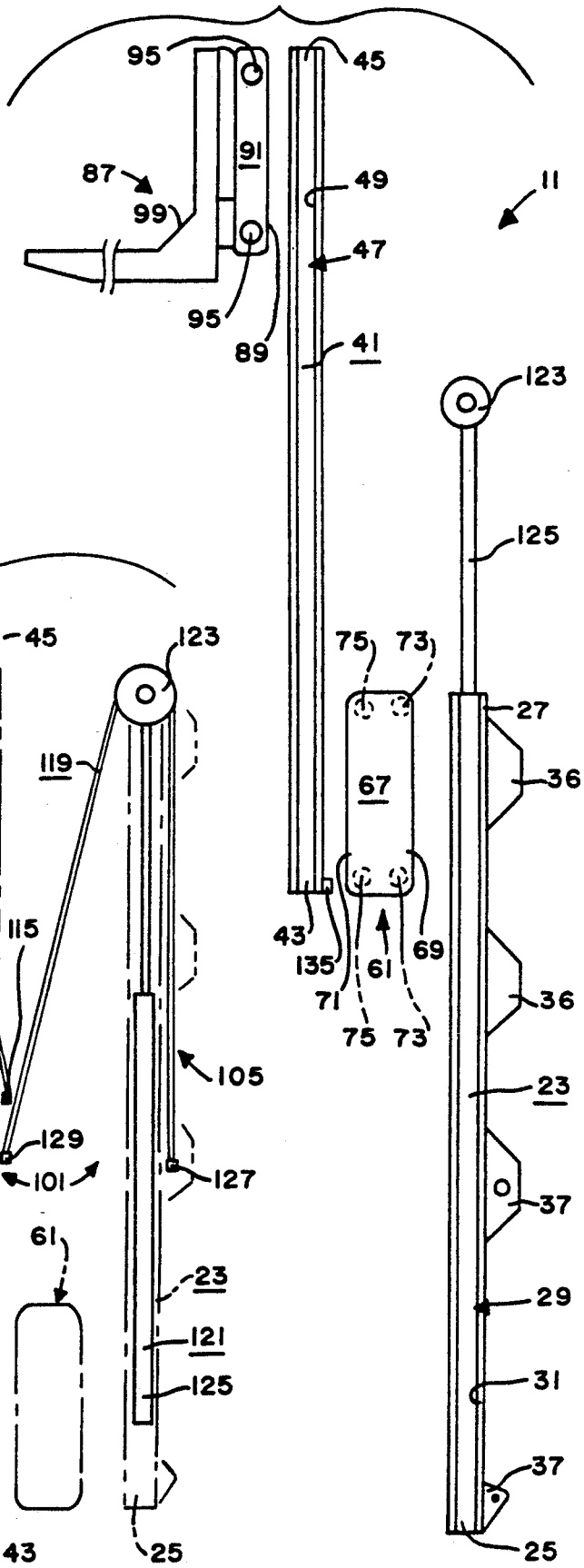
FIG. 5 is an exploded side elevational view similar to FIG. 3 but in a positive position.
Figure 6:
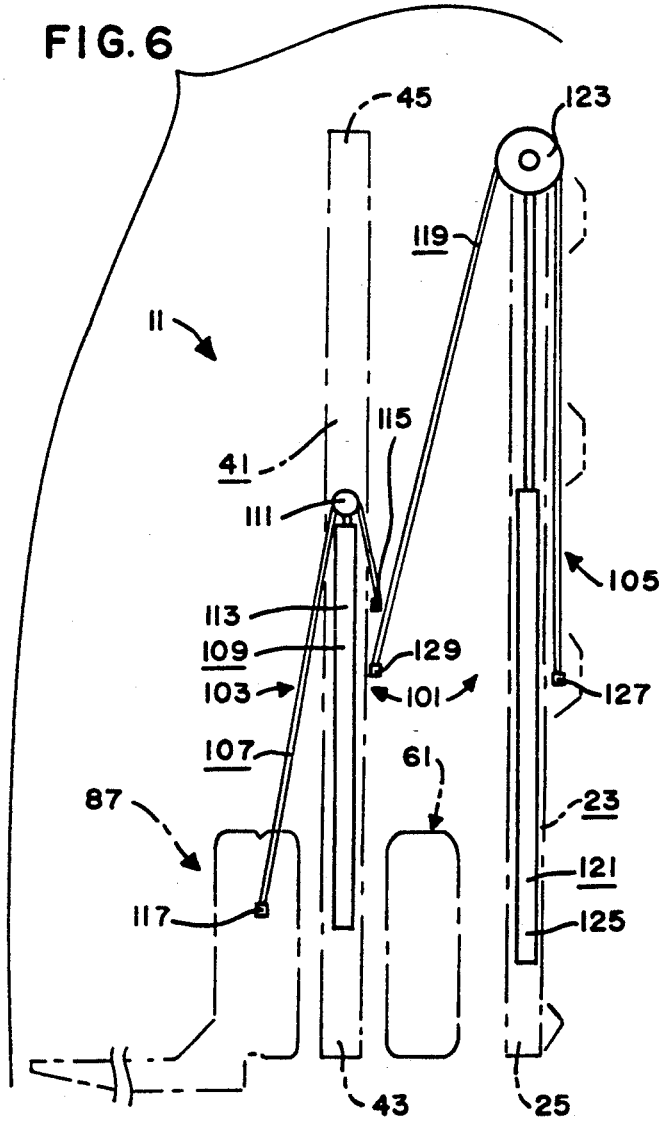
FIG. 6 is a diagrammatic view of certain lift means of the stacking mast of the present invention with certain other portions of the stacking mast shown in broken lines.

The stacking mast 11 includes a floating carriage means 61 for securing the second mast 41 to the first mast 23. The floating carriage means 61 includes first securing means 63 for being slidably secured to the first mast 23 and including second securing means 65 for being slidably secured to the second mast 41. The floating carriage means 61 preferably includes a first side 67 having a first end 69 and a second end 71. The first securing means 63 of the floating carriage means 61 preferably includes inwardly directed first roller means 73 mounted on the first end 69 of the first side 67 thereof for extending into the outwardly facing channel 31 of the first side 29 of the first mast 23 as shown in FIG. 2. The second securing means 65 of the floating carriage means 61 preferably includes inwardly directed second roller means 75 mounted on the second end 71 of the first side 67 thereof for extending into the outwardly facing channel 49 of the first side 47 of the second mast 41 as shown in FIG. 2. The floating carriage means 61 preferably includes a second side 77 having a first end 79 and a second end 81. The first securing means 63 of the floating carriage means 61 preferably includes inwardly directed third roller means 83 mounted on the first end 79 of the second side 77 thereof for extending into the outwardly facing channel 35 of the second side 33 of the first mast 23 as shown in FIG. 2. The second securing means 65 of the floating carriage means 61 preferably includes inwardly directed fourth roller means 85 mounted on the second end 81 of the second side 77 thereof for extending into the outwardly facing channel 55 of the second side 53 of the second mast 41 as shown in FIG. 2. The specific construction of the floating carriage means 61 may vary as will now be apparent to those skilled in the art. For example, each side 67, 77 thereof may be constructed out of a rigid plate of metal with stub axles provided thereon for allowing the various roller means 73, 75, 83, 85 to be rotatably mounted thereto and with various cross braces and the like fixedly joining the two sides 67, 77 to one another as will now be apparent to those skilled in the art.

The stacking mast 11 includes a support carriage 87 slidably attached to the second mast 41 for supporting the load (e.g., the boat 15). The support carriage 87 preferably includes a first end 89 having a first side 91 and a second side 93. The support carriage 87 preferably includes first roller means 95 mounted on the first side 91 of the first end 89 thereof for extending into the inwardly facing channel 51 of the first side 47 of the second mast 41 as shown in FIG. 2. The support carriage 87 preferably includes second roller means 97 mounted on the second side 93 of the first end 89 thereof for extending into the inwardly facing channel 57 of the second side 53 of the second mast 41 as shown in FIG. 2. The support carriage 87 preferably has a second end 99 especially adapted to support the load (e.g., the boat 15). Thus, the second end 99 may include typical fork lift tines and the like adapted to securely engage and support the boat 15 as will now be apparent to those skilled in the art.

The stacking mast 11 includes lift means 101 for moving the support carriage 87 between a lower position and an upper position on the second mast 41 and for moving the second mast 41 between a lower position and an upper position on the first mast 23. The lift means 101 preferably includes first lift means 103 for moving the support carriage 87 up and down on the second mast 41, and second lift means 105 for moving the second mast 41 between the lower and upper positions on the first mast 23. The first lift means 103 preferably includes cable means 107 for joining the support carriage 87 and the second mast 41 to one another, and cable control means 109 for causing the cable means 107 to move the support carriage 87 between the lower and upper ends to the second mast 41. The cable control means 109 of the first lift means 103 preferably includes a yoke assembly 111 for engaging the cable means 107, and hoist cylinder means 113 for moving the yoke assembly 111 between a lower position and an upper position. The cable means 107 may consist of one or more elongated chains or cables having a first end 115 for being fixedly attached to the second mast 41 and having a second end 117 for being fixedly attached to the support carriage 87. The hoist cylinder means 113 may consist of a typical hydraulic piston or the like and the yoke assembly 111 may consist of one or more sheave-like members for receiving a bight portion of the cable means 107 and attached to the hoist cylinder means 113 for being moved thereby to thereby cause movement of the support carriage 87 as will now be apparent to those skilled in the art. The second lift means 105 preferably includes cable means 119 for joining the first and second masts 23, 41 to one another, and cable control means 121 for causing the cable means 119 to move the second mast 41 between the lower and upper positions. The cable control means 121 of the second lift means 105 preferably includes a yoke assembly 123 for engaging the cable means 119, and hoist cylinder means 125 for moving the yoke assembly 123 between a lower position and an upper position. The cable means 119 may consist of one or more elongated chains or cables having a first end 127 for being fixedly attached to the first mast 23 and having a second end 129 for being fixedly attached to the second mast 41. The hoist cylinder means 125 may consist of a typical hydraulic piston or the like and the yoke assembly 123 may consist of one or more sheave like members for receiving a bight portion of the cable means 119 and attached to the hoist cylinder means 125 for being moved thereby to thereby cause movement of the second mast 41 as will now be apparent to those skilled in the art.

The stacking mast 11 preferably includes first control valve means 131 for controlling the hoist cylinder means 113 of the first lift means 103, and second control valve means 133 for controlling the hoist cylinder means 125 of the second lift means 105. The valve means 131, 133 may consist of a typical stacked valve bank for controlling hydraulic cylinders or the like as will now be apparent to those skilled in the art.

The stacking mast 11 preferably includes drive means 135 for driving the floating carriage means 61 upward when the second mast 41 is moved to the upper position. The drive means 135 may consist of a projection or the like on the second mast 41 adjacent the lower end 43 thereof for engaging a cross member or the like of the floating carriage means 61 to drive or pull the floating carriage means 61 up as the second mast 41 is moved upward by the second lift means 105 as will now be apparent to those skilled in the art.

In a variation upon the previously described invention, one or both of first or second masts, 23 or 41, respectively, may telescope, allowing stacking mast 11 to be reduced in overall height for passing through doorways or underneath obstacles and the like, while still maintaining substantially the same positive and negative lift heights as previously described. The second preferred embodiment of the stacking mast of the present invention, shown in FIGS. 7–12 as 2.11, is for attachment to a typical marina lift truck 2.13 for moving a boat 2.15 between a negative position as indicated by the arrow 2.17 in FIG. 7 and a positive position as indicated by the arrow 2.19 in FIG. 7. A neutral position with the boat 2.15 substantially at ground level is indicated by the arrow 2.21 in FIG. 7.

Stacking mast 2.11 includes a telescoping elongated first mast 2.23 having a lower telescoping portion 2.24 and an upper telescoping portion 2.26. The first mast 2.23 also includes a lower end 2.25 for being attached to the lift truck 2.13 in any manner now apparent to those skilled in the art such as, for example, by a pivot rod or the like. The first mast 2.23 includes an upper end 2.27. The first mast 2.23 preferably includes a first side 2.29 having an inwardly facing channel 2.31 extending from upper end 2.27 to lower end 2.25 of first mast 2.23, said inwardly facing channel 2.31 of first side 2.29 having an upper channel portion 2.32 extending downwardly from upper end 2.27 of first mast 2.23 on upper telescoping portion 2.26, as well as a lower channel portion 2.30 extending upwardly from lower end 2.25 of first mast 2.23 on lower telescoping portion 2.24; similarly, first mast 2.23 also preferably includes a second side 2.33 having an inwardly facing channel 2.35 extending between the lower and upper ends, 2.25 and 2.27, respectively, of first mast 2.23, said inwardly facing channel 2.35 of second side 2.33 having an upper channel portion 2.38 extending downwardly from upper end 2.27 of first mast 2.23 on upper telescoping portion 2.26 as well as a lower channel portion 2.34 extending upwardly from lower end 2.25 of first mast 2.23 on lower telescoping portion 2.24. The specific construction of the first mast 2.23 may vary as will now be apparent to those skilled in the art. For example, the first and second sides 2.29, 2.33 of the first mast 2.23 may be constructed as elongated metal C beams as diagrammatically shown in FIG. 8 with various cross members or cross braces 2.36, 2.50 and the like fixedly joining the C-beams on opposite sides to one another, some cross braces 2.36 joining first and second sides 2.29, 2.33 of lower telescoping portion 2.24, and other cross braces 2.50 joining first and second sides 2.29, 2.33 of upper telescoping portion 2.26, as will now be apparent to those skilled in the art. The first mast 2.23 is preferably provided with various flanges 2.37 and the like to allow the first mast 2.23 to be easily attached to the truck 2.13 and to allow various pistons and the like such as the tilt piston 2.39 (see FIG. 7) to be secured thereto for reasons and in a manner as will now be apparent to those skilled in the art.

Figure 7:
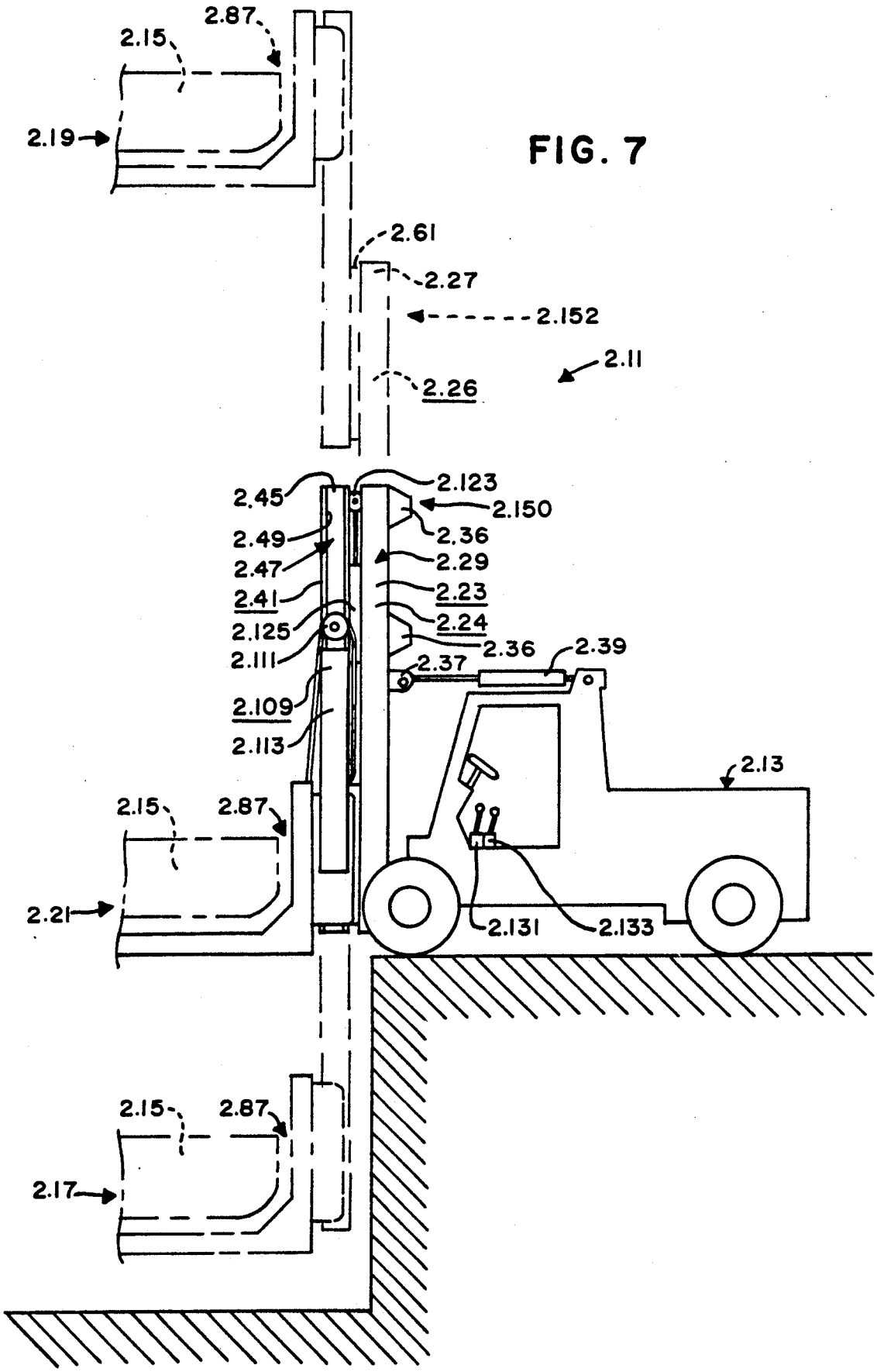
FIG. 7 is a diagrammatic side elevational view of the stacking mast of the second embodiment of the present invention shown attached to a marina lift truck with positive and negative positions shown in broken lines.
Figure 8:
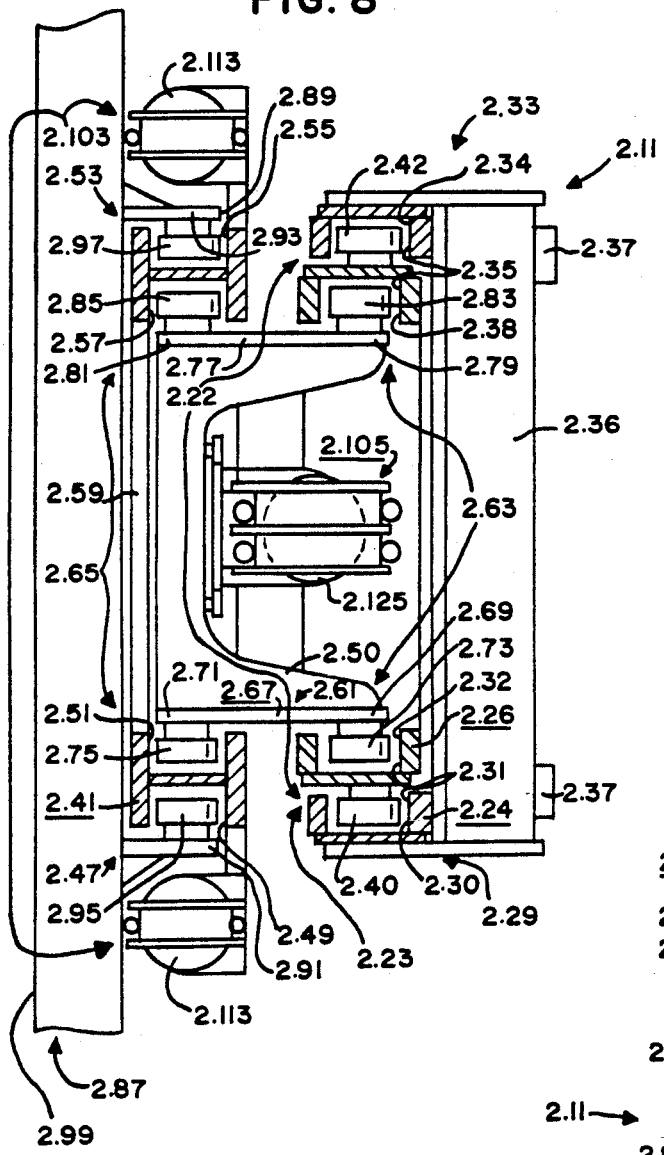
FIG. 8 is a top plan view of the stacking mast of the second embodiment of the present invention.
Figure 9:
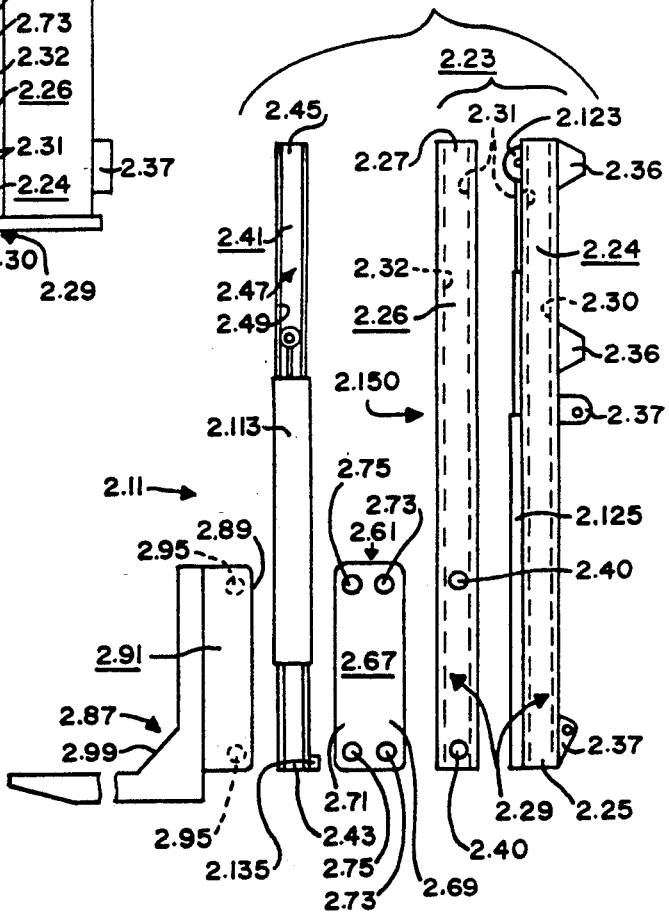
FIG. 9 is an exploded side elevational view of the stacking mast of the second embodiment of the present invention in a neutral position.
Figure 10:
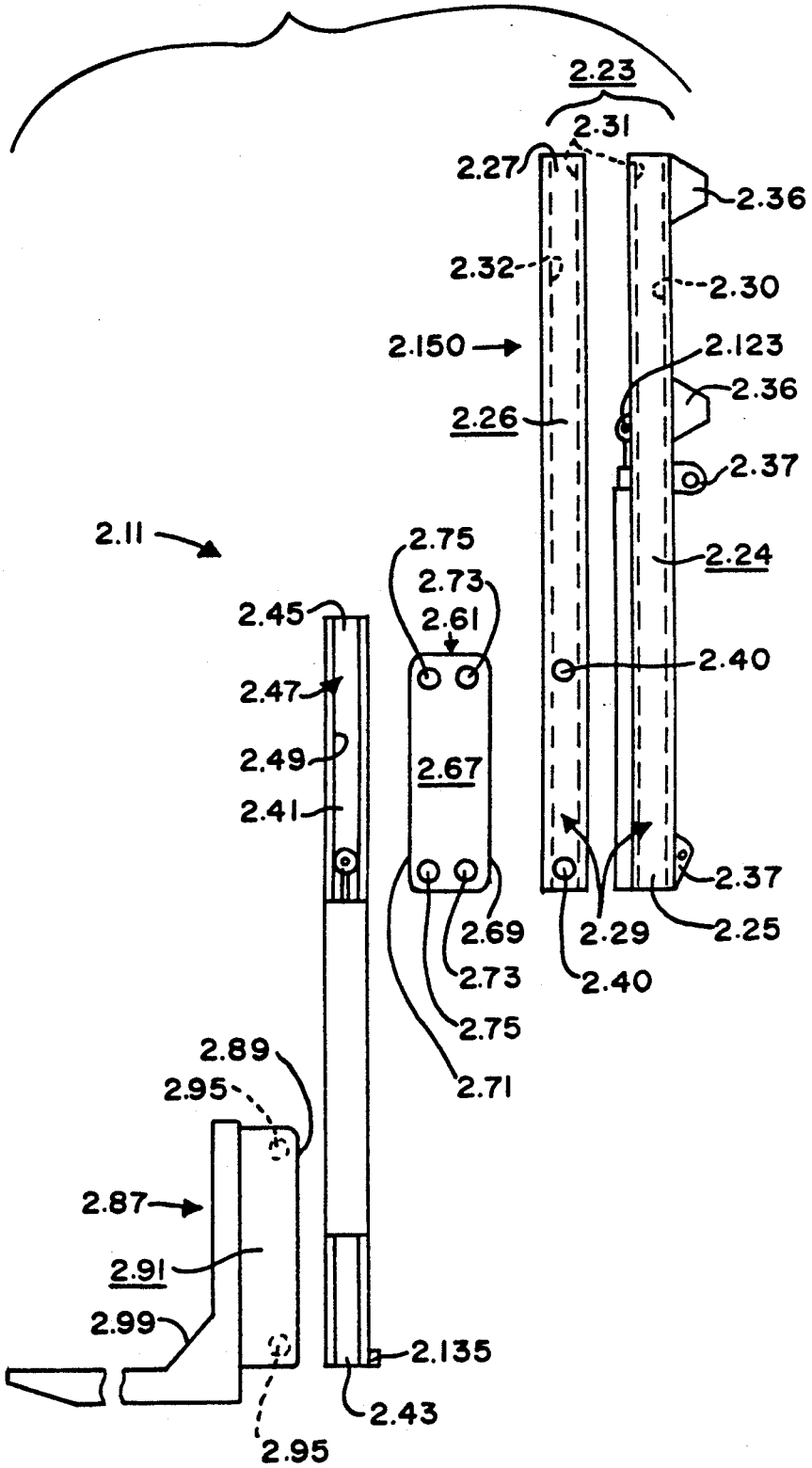
FIG. 10 is an exploded side elevational view similar to FIG. 9 but in a negative position.
Figure 11:
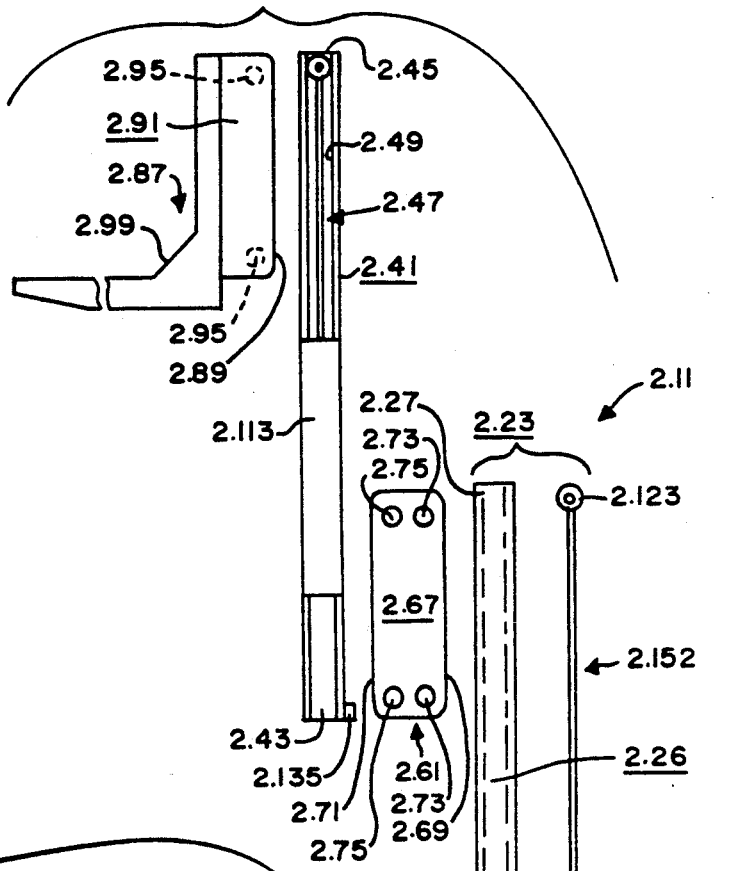
FIG. 11 is an exploded side elevational view similar to FIG. 9 but in a positive position.
Figure 12:
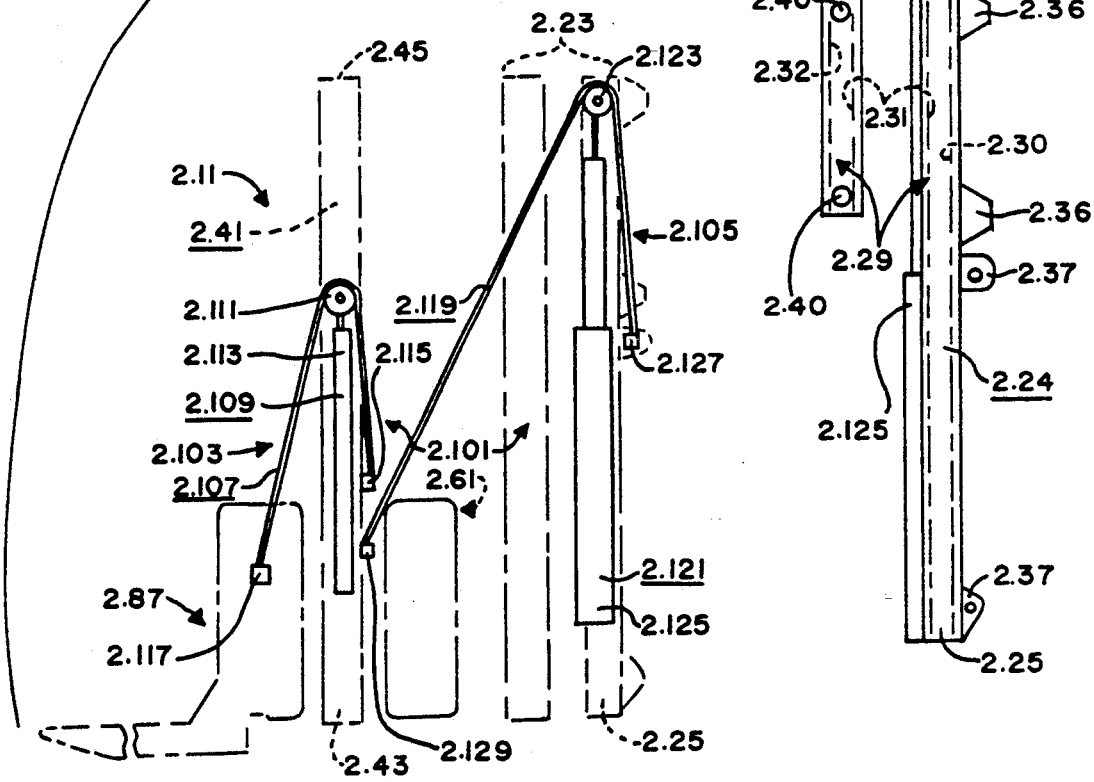
FIG. 12 is a diagrammatic view of certain lift means of the stacking mast of the second embodiment of the present invention with certain other portions of the stacking mast shown in broken lines.

Telescoping first mast 2.23 also includes telescoping means 2.22 for securing lower telescoping portion 2.24 of first mast 2.23 to upper telescoping portion 2.26 and for allowing first mast 2.23 to telescope from a retracted position 2.150 shown in FIGS. 7, 9, and 10, to an extended position 2.152 shown in FIGS. 7 and 11. Preferably, telescoping means 2.22 includes roller means, such as roller means 2.40 on first side 2.29 and extending outwardly therefrom, and also preferably such as roller means 2.42 on second side 2.33, attached to lower telescoping portion 2.24 of first mast 2.23 and extending outwardly therefrom, each said roller means also for slidably securing lower telescoping portion 2.24 to upper telescoping portion 2.26 by extending into lower channel portions 2.30 and 2.34, respectively, in a manner now apparent to those skilled in the art from FIG. 8.

The stacking mast 2.11 includes an elongated second mast 2.41. The second mast 2.41 includes a lower end 2.43 and an upper end 2.45. The second mast 2.41 preferably includes a first side 2.47 having an outwardly facing channel 2.49 extending between the lower and upper ends 2.43, 2.45 thereof and having an inwardly facing channel 2.51 extending between the lower and upper ends 2.43, 2.45 thereof. The second mast 2.41 preferably includes a second side 2.53 having an outwardly facing channel 2.55 extending between the lower and upper ends 2.43, 2.45 thereof and an inwardly facing channel 2.57 extending between the lower and upper ends thereof 2.43, 2.45. The specific construction of the second mast 2.41 may vary as will now be apparent to those skilled in the art. For example, the first and second sides 2.47, 2.53 of the second mast 2.41 may be constructed as elongated metal I beams as diagrammatically shown in FIG. 8 with various cross braces 2.59 and the like fixedly joining the two I-beams to one another as will now be apparent to those skilled in the art.

The stacking mast 2.11 includes a floating carriage means 2.61 for securing the second mast 2.41 to the first mast 2.23. The floating carriage means 2.61 includes first securing means 2.63 for being slidably secured to the first mast 2.23 and including second securing means 2.65 for being slidably secured to the second mast 2.41. The floating carriage means 2.61 preferably includes a first side 2.67 having a first end 2.69 and a second end 2.71. The first securing means 2.63 of the floating carriage means 2.61 preferably includes outwardly directed first roller means 2.73 mounted on the first end 2.69 of the first side 2.67 thereof for extending into upper channel portion 2.32 of inwardly facing channel 2.31 of the first side 2.29 of upper telescoping portion 2.26 of first mast 2.23 as shown in FIG. 8. The second securing means 2.65 of the floating carriage means 2.61 preferably includes outwardly directed second roller means 2.75 mounted on the second end 2.71 of the first side 2.67 thereof for extending into the inwardly facing channel 2.51 of the first side 2.47 of the second mast 2.41 as shown in FIG. 8. The floating carriage means 2.61 preferably includes a second side 2.77 having a first end 2.79 and a second end 2.81. The first securing means 2.63 of the floating carriage means 2.61 preferably includes outwardly directed third roller means 2.83 mounted on the first end 2.79 of the second side 2.77 thereof for extending into upper channel portion 2.38 of inwardly facing channel 2.35 of the second side 2.33 of upper telescoping portion 2.26 of first mast 2.23 a shown in FIG. 8. The second securing means 2.65 of the floating carriage means 2.61 preferably includes outwardly directed fourth roller means 2.85 mounted on the second end 2.81 of the second side 2.77 thereof for extending into the inwardly facing channel 2.57 of the second side 2.53 of the second mast 2.41 as shown in FIG. 8. The specific construction of the floating carriage means 2.61 may vary as will now be apparent to those skilled in the art. For example, each side 2.67, 2.77 thereof may be constructed out of a rigid plate of metal with stub axles provided thereon for allowing the various roller means 2.73, 2.75, 2.83, 2.85 to be rotatably mounted thereto and with various cross braces and the like fixedly joining the two sides 2.67, 2.77 to one another as will now be apparent to those skilled in the art.

The stacking mast 2.11 includes a support carriage 2.87 slidably attached to the second mast 2.41 for supporting the load (e.g., the boat 2.15). The support carriage 2.87 preferably includes a first end 2.89 having a first side 2.91 and a second side 2.93. The support carriage 2.87 preferably includes first roller means 2.95 mounted on the first side 2.91 of the first end 2.89 thereof for extending into the outwardly facing channel 2.49 of the first side 2.47 of the second mast 2.41 as shown in FIG. 8. The support carriage 2.87 preferably includes second roller means 2.97 mounted on the second side 2.93 of the first end 2.89 thereof for extending into the outwardly facing channel 2.55 of the second side 2.53 of the second mast 2.41 as shown in FIG. 8. The support carriage 2.87 preferably has a second end 2.99 especially adapted to support the load (e.g., the boat 2.15). Thus, the second end 2.99 may include typical fork lift tines and the like adapted to securely engage and support the boat 2.15 as will now be apparent to those skilled in the art.

The stacking mast 2.11 includes lift means 2.101 for moving the support carriage 2.87 between a lower position and an upper position on the second mast 2.41 and for moving the second mast 2.41 between a lower position and an upper position on the first mast 2.23. The lift means 2.101 preferably includes first lift means 2.103 for moving the support carriage 2.87 up and down on the second mast 2.41, and second lift means 2.105 for moving the second mast 2.41 between the lower and upper positions on the first mast 2.23. The first lift means 2.103 preferably includes cable means 2.107 for joining the support carriage 2.87 and the second mast 2.41 to one another, and cable control means 2.109 for causing the cable means 2.107 to move the support carriage 2.87 between the lower and upper ends of the second mast 2.41. The cable control means 2.109 of the first lift means 2.103 preferably includes a yoke assembly 2.111 for engaging the cable means 2.107, and hoist cylinder means 2.113 for moving the yoke assembly 2.111 between a lower position and an upper position. The cable means 2.107 may comprise one or more elongated chains or cables having a first end 2.115 for being fixedly attached to the second mast 2.41 and having a second end 2.117 for being fixedly attached to the support carriage 2.87. The hoist cylinder means 2.113 may comprise a typical hydraulic piston or the like and the yoke assembly 2.111 may comprise one or more sheave-like members for receiving a bight portion of the cable means 2.107 and attached to the hoist cylinder means 2.113 for being moved thereby to thereby cause movement of the support carriage 2.87 as will now be apparent to those skilled in the art. Preferably, cable control means 2.109 comprises a pair of hoist cylinder means 2.113 shown in FIG. 8, one on first side 2.47 and one on second side 2.53 of second mast 2.41, each with associated yoke assemblies 2.111 and cable means 2.107, in a manner now apparent to those skilled in the art.

The second lift means 2.105 preferably includes cable means 2.119 for joining the first and second masts 2.23, 2.41 to one another, and cable control means 2.121 for causing the cable means 2.!19 to move the second mast 2.41 between the lower and upper positions. The cable control means 2.121 of the second lift means 2.105 preferably includes a yoke assembly 2.123 for engaging the cable means 2.119, and hoist cylinder means 2.125 for moving the yoke assembly 2.123 between a lower position and an upper position. The cable means 2.119 may comprise one or more elongated chains or cables having a first end 2.127 for being fixedly attached to the first mast 2.23 on lower telescoping portion 2.24 and having a second end 2.129 for being fixedly attached to the second mast 2.41. The hoist cylinder means 2.!25 may comprise a typical hydraulic piston or the like, preferably a two-stage hydraulic piston well known to those skilled in the art, and the yoke assembly 2.123 may comprise one or more sheave-like members for receiving a bight portion of the cable means 2.119 and attached to the hoist cylinder means 2.125 for being moved thereby to thereby cause movement of the second mast 2.41 as will now be apparent to those skilled in the art. As hoist cylinder means 2.125 becomes fully extended, upper telescoping portion 2.26 of first mast 2.23 will also become fully telescoped on lower telescoping portion 2.24 of first mast 2.23, thereby extending the length of first mast 2.23 in a manner that will now be understood by those skilled in the art, as second mast 2.41 is moved upwardly on first mast 2.23.

The stacking mast 2.11 preferably includes first control valve means 2.131 for controlling the hoist cylinder means 2.113 of the first lift means 2.103, and second control valve means 2.133 for controlling the hoist cylinder means 2.125 of the second lift means 2.105. The valve means 2.131, 2.133 may comprise a typical stacked valve bank for controlling hydraulic cylinders or the like as will now be apparent to those skilled in the art.

The stacking mast 2.11 preferably includes drive means 2.135 for driving the floating carriage means 2.61 upward when the second mast 2.41 is moved to the upper position. The drive means 2.135 may comprise a projection or the like on the second mast 2.41 adjacent the lower end 2.43 thereof for engaging a cross member or the like of the floating carriage means 2.61 to drive or pull the floating carriage means 2.61 up as the second mast 2.41 is moved upward by the second lift means 2.105 as will now be apparent to those skilled in the art.

Although the present invention has been described an illustrated with respect to a preferred embodiment and a preferred use therefor, it is not to be so limited since modifications and changes can be made therein which are within the full intended scope of the invention.

I claim:

1. A stacking mast for being attached to a lift truck and for moving a load between a negative position and a positive position, said stacking mast comprising:

a) an elongated first mast, said first mast including a lower end for being attached to said lift truck and including an upper end;

b) an elongated second mast, said second mast including a lower end and an upper end;

c) a floating carriage means for securing said second mast to said first mast, said floating carriage means including first securing means for being slidably secured to said first mast and including second securing means for being slidably secured to said second mast;

d) a support carriage slidably attached to said second mast for supporting said load; and e) lift means for moving said support carriage between a lower position and an upper position on said second mast and for moving said second mast between a lower position and an upper position on said first mast.

2. The stacking mast of claim 1 in which said first mast includes a first side having an outwardly facing channel extending between said lower and upper ends thereof and includes a second side having an outwardly facing channel extending between said lower and upper ends thereof.

3. The stacking mast of claim 2 in which said second mast includes a first side having an outwardly facing channel extending between said lower and upper ends thereof and having an inwardly facing channel extending between said lower and upper ends thereof; and in which said second mast includes a second side having an outwardly facing channel extending between said lower and upper ends thereof and an inwardly facing channel extending between said lower and upper ends thereof.

4. A stacking mast for being attached to a lift truck and for moving a load between a negative position and a positive position, said stacking mast comprising:

a) an elongated first mast, said first mast including:

i. a lower end for being attached to said lift truck;

ii. an upper end;

iii. a first side having an outwardly facing channel extending between said lower and upper ends thereof; and iv. a second side having an outwardly facing channel extending between said lower and upper ends thereof;

b) an elongated second mast, said second mast including:

i. a lower end;

ii. an upper end;

iii. a first side having an outwardly facing channel extending between said lower and upper ends thereof and having an inwardly facing channel extending between said lower and upper ends thereof; and iv. a second side having an outwardly facing channel extending between said lower and upper ends thereof and an inwardly facing channel extending between said lower and upper ends thereof;

c) a floating carriage means for securing said second mast to said first mast, said floating carriage means including:

i. a first side having a first end and a second end;

ii. first securing means for being slidably secured to said first mast, said first securing means of said floating carriage means including inwardly directed first roller means mounted on said first end of said first side thereof for extending into said outwardly facing channel of said first side of said first mast; and iii. second securing means for being slidably secured to said second mast, said second securing means of said floating carriage means including inwardly directed second roller means mounted on said second end of said first side thereof for extending into said outwardly facing channel of said first side of said second mast;

d) a support carriage slidably attached to said second mast for supporting said load; and e) lift means for moving said support carriage between a lower position and an upper position on said second mast and for moving said second mast between a lower position and an upper position on said first mast.

5. The stacking mast of claim in which said floating carriage means includes a second side having a first end and a second end; in which said first securing means of said floating carriage means includes inwardly directed third roller means mounted on said first end of said second side thereof for extending into said outwardly facing channel of said second side of said first mast; and in which said second securing means of said floating carriage means includes inwardly directed fourth roller means mounted on said second end of said second side thereof for extending into said outwardly facing channel of said second side of said second mast.

6. The stacking mast of claim 5 in which said support carriage includes a first end having a first side and a second side; in which said support carriage includes first roller means mounted on said first side of said first end thereof for extending into said inwardly facing channel of said first side of said second mast; and in which said support carriage includes second roller means mounted on said second side of said first end thereof for extending into said inwardly facing channel of said second side of said second mast.

7. The stacking mast of claim 6 in which said lift means includes first lift means for moving said support carriage up and down on said second mast.

8. The stacking mast of claim 7 in which said lift means includes second lift means for moving said second mast between said lower and upper positions on said first mast.

9. The stacking mast of claim 8 in which said first lift means includes cable means for joining said support carriage and said second mast to one another; and in which said first lift means includes cable control means for causing said cable means to move said support carriage between said lower and upper ends of said second mast.

10. The stacking mast of claim 9 in which said cable control means of said first lift means includes a yoke assembly for engaging said cable means and includes hoist cylinder means for moving said yoke assembly between a lower position and an upper position.

11. The stacking mast of claim 10 in which said second lift means includes cable means for joining said second and first masts to one another; and in which said second lift means includes cable control means for causing said cable means of said second lift means to move said second mast between said lower and upper positions on said first mast.

12. The stacking mast of claim 11 in which said cable control means of said second lift means includes a yoke assembly for engaging said cable means of said second lift means and includes hoist cylinder means for moving said yoke assembly of said second lift means between a lower position and an upper position.

13. The stacking mast of claim 12 in which is included first control valve means for controlling said hoist cylinder means of said first lift means; and in which is also included second control valve means for controlling said hoist cylinder means of said second lift means.

14. The stacking mast of claim 1 in which is included means for driving said floating carriage means upward when said second mast is moved to said upper position on said first mast.

15. A stacking mast for being attached to a marina lift truck and for lifting a boat from a negative position below ground level to a positive position above ground level, said stacking mast comprising:

a) an elongated first mast, said first mast including a lower end for being attached to said marina lift truck and including an upper end; said first mast including a first side having an outwardly facing channel extending between said lower and upper ends thereof and including a second side having an outwardly facing channel extending between said lower and upper ends thereof;

b) an elongated second mast; said second mast including a lower end and an upper end; said second mast including a first side having an outwardly facing channel extending between said lower and upper ends thereof and having an inwardly facing channel extending between said lower and upper ends thereof; said second mast including a second side having an outwardly facing channel extending between said lower and upper ends thereof and an inwardly facing channel extending between said lower and upper ends thereof;

c) a floating carriage means for securing said second mast to said first mast; said floating carriage means including a first side having a first end and a second end; said floating carriage means including inwardly directed first roller means mounted on said first end of said first side thereof for extending into said outwardly facing channel of said first side of said first mast; said floating carriage means including inwardly directed second roller means mounted on said second end of said first side thereof for extending into said outwardly facing channel of said first side of said second mast; said floating carriage means including a second side having a first end and a second end; said floating carriage means including inwardly directed third roller means mounted on said first end of said second side thereof for extending into said outwardly facing channel of said second side of said first mast; said floating carriage means including inwardly directed fourth roller means mounted on said second end of said second side thereof for extending into said outwardly facing channel of said second side of said second mast;

d) a support carriage slidably attached to said second mast for supporting said boat; said support carriage including a first end having a first side and a second side; said support carriage including first roller means mounted on said first side of said first end thereof for extending into said inwardly facing channel of said first side of said second mast; said support carriage including second roller means mounted on said second side of said first end thereof for extending into said inwardly facing channel of said second side of said second mast;

e) first lift means for moving said support carriage up and down on said second mast; said first lift means including cable means for joining said support carriage and said second mast to one another and including cable control means for causing said cable means to move said support carriage between said lower and upper ends of said second mast; said cable control means including a yoke assembly for engaging said cable means and hoist cylinder means for moving said yoke assembly between a lower position and an upper position;

f) second lift means for moving said second mast between a lower and upper position on said first mast; said second lift means including cable means for joining said second and first masts to one another and including cable control means for causing said cable means of said second lift means to move said second mast between said lower and upper positions on said first mast; said cable control means of said second lift means including a yoke assembly for engaging said cable means of said second lift means and hoist cylinder means for moving said yoke assembly of said second lift means between a lower position and an upper position;

g) first control valve means for controlling said hoist cylinder means of said first lift means; and h) second control valve means for controlling said hoist cylinder means of said second lift means.

16. The stacking mast as described in claim 1 in which said first mast may telescope, said first mast including a lower telescoping portion, an upper telescoping portion, and telescoping means for securing the lower telescoping portion to the upper telescoping portion and for allowing said first mast to telescope from a retracted position to an extended position.

17. The stacking mast as described in claim 16 in which said first mast includes a first side and a second side, each said first and second side of said first mast having:

a. an inwardly facing upper channel portion extending downwardly from said upper end of said first mast on said upper telescoping portion, and b. an inwardly facing lower channel portion extending upwardly from said lower end of said first mast on said lower telescoping portion;

and in which said second mast includes a first side and a second side, each said first and second side of said second mast having:

a. an inwardly facing channel extending between said lower and upper ends thereof, and b. an outwardly facing channel extending between said lower and upper ends thereof.

18. A stacking mast for being attached to a lift truck and for moving a load between a negative position and a positive position, said stacking mast comprising:

a) an elongated telescoping first mast, said first mast including:

i. a lower end for being attached to said lift truck;

ii. an upper end;

iii. a lower telescoping portion;

iv. an upper telescoping portion;

v. telescoping means for securing the lower telescoping portion to the upper telescoping portion and for allowing said first mast to telescope from a retracted position to an extended position;

vi. a first side; and vii. a second side, each said first and second side of said first mast having an inwardly facing upper channel portion extending downwardly from said upper end of said first mast on said upper telescoping portion, and further having an inwardly facing lower channel portion extending upwardly from said lower end of said first mast on said lower telescoping portion;

b) an elongated second mast, said second mast including:

i. a lower end;

ii. an upper end;

iii. a first side; and iv. a second side, each said first and second side of said second mast having an inwardly facing channel extending between said lower and upper ends thereof, and further having an outwardly facing channel extending between said lower and upper ends thereof;

c) a floating carriage means for securing said second mast to said first mast, said floating carriage means including:

i. first securing means for being slidably secured to said first mast;

ii. second securing means for being slidably secured to said second mast; and iii. a first side having a first end and a second end, said first securing means of said floating carriage means including outwardly directed first roller means mounted on said first end of said first side thereof for extending into said inwardly facing upper channel portion of said first side of said first mast, and said second securing means of said floating carriage means including outwardly directed second roller means mounted on said second end of said first side thereof for extending into said inwardly facing channel of said first side of said second mast;

d) a support carriage slidably attached to said second mast for supporting said load; and e) lift means for moving said support carriage between a lower position and an upper position on said second mast and for moving said second mast between a lower position and an upper position on said first mast.

19. The stacking mast as described in claim 18 in which said floating carriage means includes a second side having a first end and a second end; in which said firsts securing means of said floating carriage means includes outwardly directed third roller means mounted on said first end of said second side thereof for extending into said outwardly facing upper channel portion of said second side of said first mast; and in which said second securing means of said floating carriage means includes outwardly directed fourth roller means mounted on said second end of said second side thereof for extending into said inwardly facing channel of said second side of said second mast.

20. The stacking mast as described in claim 19 in which said support carriage includes a first end having a first side and a second side; in which said support carriage includes first roller means mounted on said first side of said first end thereof for extending into said outwardly facing channel of said first side of said second mast; and in which said support carriage includes second roller means mounted on said second side of said first end thereof for extending into said outwardly facing channel of said second side of said second mast.

21. The stacking mast as described in claim 20 in which said lift means includes first lift means for moving said support carriage up and down on said second mast.

22. The stacking mast a described in claim 21 in which said lift means includes second lift means for moving said second mast between said lower and upper positions on said first mast.

23. The stacking mast a described in claim 22 in which said first lift means includes cable means for joining said support carriage and said second mast to one another; and in which said first lift means includes cable control means for causing said cable means to move said support carriage between said lower and upper ends of said second mast.

24. The stacking mast as described in claim 23 in which said cable control means of said first lift means includes a yoke assembly for engaging said cable means and includes hoist cylinder means for moving said yoke assembly between a lower position and an upper position.

25. The stacking mast as described in claim 24 in which said second lift means includes cable means for joining said second and first masts to one another; and in which said second lift means includes cable control means for causing said cable means of said second lift means to move said second mast between said lower and upper positions on said first mast.

26. The stacking mast as described in claim 25 in which said cable control means of said second lift means includes a yoke assembly for engaging said cable means of said second lift means and includes hoist cylinder means for moving said yoke assembly of said second lift means between a lower position and an upper position.

27. The stacking mast as described in claim 26 in which is included first control valve means for controlling said hoist cylinder means of said first lift means; and in which is also included second control valve means for controlling said hoist cylinder means of said second lift means.

* * * * *